US007754663B2

(12) United States Patent
Habeeb et al.

(10) Patent No.: US 7,754,663 B2
(45) Date of Patent: Jul. 13, 2010

(54) PREMIUM WEAR-RESISTANT LUBRICANT CONTAINING NON-IONIC ASHLESS ANTI-WEAR ADDITIVES

(75) Inventors: Jacob Joseph Habeeb, Westfield, NJ (US); Heather M. Haigh, Philadelphia, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1114 days.

(21) Appl. No.: 11/301,543

(22) Filed: Dec. 13, 2005

(65) Prior Publication Data

US 2006/0135376 A1 Jun. 22, 2006

Related U.S. Application Data

(60) Provisional application No. 60/637,794, filed on Dec. 21, 2004.

(51) Int. Cl.
*C10M 159/18* (2006.01)
*C10M 135/26* (2006.01)

(52) U.S. Cl. ..... 508/244; 508/243; 508/267; 508/509; 508/516; 508/518

(58) Field of Classification Search ..... 508/243, 508/516, 518, 267, 509, 244
See application file for complete search history.

(56) References Cited

U.S. PATENT DOCUMENTS

| | | | | | |
|---|---|---|---|---|---|
| 2,443,264 | A | | 6/1948 | Mikeska | 252/46.6 |
| 2,471,115 | A | | 5/1949 | Mikeska | 260/461 |
| 2,526,497 | A | | 10/1950 | Mikeska | 252/46.6 |
| 2,591,577 | A | | 4/1952 | McDermott | 252/46.6 |
| 3,770,854 | A | | 11/1973 | Morris | 260/985 |
| 4,006,156 | A | * | 2/1977 | Powell | 548/146 |
| 4,174,284 | A | * | 11/1979 | Borel et al. | 508/517 |
| 4,501,678 | A | | 2/1985 | Katayama et al. | 252/32.7 |
| 4,758,362 | A | | 7/1988 | Butke | 252/47.5 |
| 4,764,294 | A | | 8/1988 | Habeeb et al. | 252/32.7 E |
| 4,941,984 | A | | 7/1990 | Chamberlin, III et al. | 252/39 |
| 5,693,598 | A | | 12/1997 | Abraham et al. | 508/444 |
| 5,856,280 | A | * | 1/1999 | Kim et al. | 508/509 |
| 6,165,949 | A | | 12/2000 | Berlowitz et al. | 508/363 |
| 6,475,960 | B1 | | 11/2002 | Berlowitz et al. | 508/110 |

* cited by examiner

*Primary Examiner*—Cephia D Toomer
(74) *Attorney, Agent, or Firm*—Estelle C. Bakun

(57) ABSTRACT

A premium wear resistant lubricant comprises a base stock, preferably a GTL liquid or the liquid isomerization product of slack wax or F-T wax, and a non-ionic ashless anti-wear additive. The non-ionic ashless antiwear additive is preferably at least one of thiosalicylic acid or alkyl ester thereof, thioxomalonate, 2,2-dithiopyridine and thiazolidine. The lubricant may also contain additional base stock materials selected from other hydrocarbonaceous and synthetic base stock materials in admixture with the GTL liquid or slack wax or F-T derived base stock.

17 Claims, No Drawings

PREMIUM WEAR-RESISTANT LUBRICANT CONTAINING NON-IONIC ASHLESS ANTI-WEAR ADDITIVES

This application claims the benefit of U.S. Ser. No. 60/637,794 filed Dec. 21, 2004.

BACKGROUND OF THE DISCLOSURE

1. Field of the Invention

The invention relates to wear resistant lubricating oil formulations comprising a natural, synthetic or unconventional base oil or mixtures thereof, preferably a base stock derived from waxy feed, preferably waxy Fischer-Tropsch (F-T) hydrocarbons and containing an effective amount of one or more antiwear additives.

2. Related Art

Internal combustion engine lubricating oils require the presence of antiwear additives in order to provide adequate antiwear protection for the engine. Increasing specifications for engine oil performance have exhibited a trend for increasing antiwear properties of the oil. While there are many different types of antiwear additives, for several decades the principal antiwear additive for internal combustion engine crankcase oils has been a metal alkyl-thiophosphate and more particularly a metal dialkyldithiophosphate in which the primary metal constituent is zinc, or zinc dialkyldithiophosphate (ZDDP). The ZDDP is typically used in amounts of from about 0.7 to 1.4 wt % of the total lube oil composition. However, it has been found that the phosphorus from these additives has a deleterious effect on the catalyst in catalytic converters and also on oxygen sensors in automobiles. Furthermore, some antiwear additives add to engine deposits, which causes increased oil consumption and an increase in particulate and regulated gaseous emissions. Therefore, reducing the amount of metal dialkyldithiophosphate such as ZDDP in the oil without compromising wear performance would be desirable. OEMs are requiring low ash/reduced ash specifications for current and future light diesel vehicles. One solution to this problem is to use expensive supplementary, phosphorus-free antiwear additives as set forth, for example, in U.S. Pat. No. 4,764,294.

In U.S. Pat. No. 6,165,949 it is taught that premium lubricant oil formulations which exhibit enhanced antiwear properties comprise a base oil derived from a waxy F-T feedstock by the isomerization of such waxy feed and dewaxing the isomerate, to which is added an antiwear additive. The antiwear additives recited include a long list of such materials including metal phosphates, preferably metal dithiophosphates, metal thiocarbamates, metal dithiocarbamates and ashless antiwear additives exemplified by ethoxylated amine dialkyldithiophosphates and ethoxylated amine dithiobenzoates which are ionic. The preferred antiwear additive is identified as zinc dialkyldithiophosphate.

It would be an improvement to the art if the antiwear performance of a lubricating oil formulation could be improved beyond the levels currently achievable with the heretofore-disclosed and identified antiwear additive without resort to the use merely of greater quantities of such additives. Further, current and future specification for engine oils call for reduced ash in the oil for the next generation of vehicles.

SUMMARY OF THE INVENTION

The invention relates to a wear resistant lubricant comprising an admixture of an effective amount of a non-ionic antiwear additive and a lubricant base stock which is any natural, synthetic, or unconventional base oil or mixtures thereof including Group I stocks, Group II stocks, Group III stocks, PAO and stocks derived from slack wax or waxy hydrocarbon stocks, or waxy synthesized hydrocarbon stocks preferably base stocks derived by hydroisoerizaion or isodewaxing slack wax or waxy F-T synthesized hydrocarbons. The lubricant is obtained by adding to, blending or admixing the non-ionic antiwear additive with the base stock.

Fully formulated lubricating oils such as, for example, motor oils, transmission oils, turbine oils and hydraulic oils all typically contain at least one, and more typically a plurality of additional performance enhancing additives not related to antiwear properties. These additional additives may include for example a detergent, a dispersant, an antioxidant, a pour point depressant, a VI improver, a friction modifier, a demulsifier, an antifoamant, a corrosion inhibitor, and a seal swell control additive. In addition, minor amounts of other antiwear additives such as the metal phosphate, metal thiophosphate, metal dialkyldithiophosphate, metal carbamate, metal thiocarbamate, metal dialkyldithiocarbamate, metal dithiobenzoate, and metal xathates can also be present.

As a practical matter, fully formulated lubricating oils of the type referred to above will typically contain at least one additional performance enhancing additive, for example, a detergent or dispersant, antioxidant, viscosity index (VI) improver, etc., and mixture thereof.

Another embodiment of the invention resides in either reducing the amount of antiwear additive required for a given performance level in a fully formulated lubricating oil composition or increasing the wear resistance of a lubricant or fully formulated lubricating oil at a given level of non-ionic antiwear additive.

The fully formulated lubricating oils comprising the oil and non-ionic ashless antiwear additive have unexpectedly been found to be superior in anti-wear performance compared to lubricating oils comprising base oil additized with the heretofore known and used metal containing antiwear additive and ashless antiwear additive such as ethoxylated amine dialkyldithiophosphates and ethoxylated amine dithiobenzoates.

Although the benefit of the present invention is obtained in formulations employing any base stock, preferred base stocks useful in the practice of the invention are those which comprise GTL liquids or hydroisomerized slack wax or hydroisomerized GTL material, preferably hydroisomerized Tropsch synthesized hydrocarbons.

DETAILED DESCRIPTION

A wear resistant lubricant which includes both greases and fully formulated lubricating oils, is prepared by forming an admixture of an effective amount of at least one non-ionic ashless antiwear additive and a base stock.

Illustrative but non-limiting examples of a material useful as a non-ionic ashless antiwear additive include thiosalicylic acid, organic group substituted thiosalicylic acid, organic esters of thiosalicylic acid, organic esters of organic group substituted thiosalicylic acid, (I), thioxomalonate (II), 2,2-dithiodipyridene, organic group substituted 2,2 dithiodipyridene (III), thiazolidine, and organic group substituted thiazolidine (IV), generally represented by the formulas

I

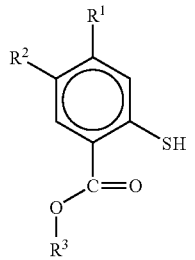

wherein $R^1$ and $R^2$ are the same or different and selected from H and organic groups containing 6 to 30 carbons, preferably 8 to 24 carbons, more preferably 14 to 20 carbons, and $R^3$ is H or organic groups containing 1 to 20 carbons;

II

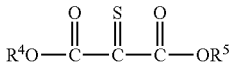

wherein $R^4$ and $R^5$ are the same or different and are selected from organic groups having from 1-20 carbons, preferably 2 to 10 carbons, more preferably 2 to 5 carbons;

III

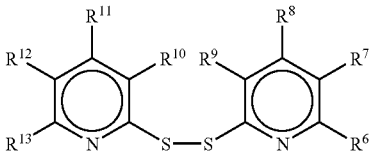

wherein $R^6$ to $R^{13}$ are the same or different and are selected from H and organic groups having 1 to 20 carbons, preferably 1 to 10 carbons, more preferably 1 to 5 carbons;

IV

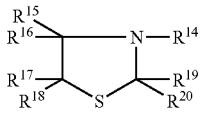

wherein $R^{14}$-$R^{20}$ are the same or different and are selected from H and organic groups having 1 to 20 carbons, preferably 1 to 10 carbons, more preferably 1 to carbons.

As used herein and in the claims, the term "organic", "organic group" or "organic radical" refers to a group or radical attached to the remainder of the molecule through a carbon atom and made up of carbon and hydrogen and optionally heteroatoms selected from one or more of nitrogen, sulfur and oxygen, said heteroatoms when present being present as skeletal atoms and/or substitutent group(s).

Organic group or radical includes: groups or radicals composed exclusively of carbon and hydrogen and include aliphatic groups or radicals which embrace linear and branched alkyl and linear and branched alkenyl groups or radicals, cycloaliphatic groups or radicals which embrace cycloalkyl and cycloalkenyl groups or radicals, aromatic groups or radicals, including mono cyclic, fused polycyclic, spiro compounds and multi cyclic compounds wherein individual cycles or polycycles are attached through alkylene or hetero atom bridges aromatic groups or radicals substituted with aliphatic or cycloaliphatic groups or radicals, and aliphatic or cycloaliphatic groups or radicals substituted with aromatic groups, or radicals as well as cyclo groups formed when the ring is completed through different portions of the molecule attaching together to form the cyclo group; groups or radicals composed of carbon, hydrogen and one or more than one of the same or different heteroatoms (nitrogen, sulfur, oxygen) wherein the heteroatoms are present as skeletal elements in the carbon and hydrogen containing chain or ring; groups or radicals composed of carbon, hydrogen and one or more than one of the same or different heteroatoms (nitrogen, sulfur, oxygen) as substituent group on the carbon and hydrogen containing chain or ring of carbon, hydrogen and heteroatom containing chain or ring, said heteroatom substituent groups including by way of non-limiting example hydroxy, alkoxy, ether, ester, carboxyl, mercapto, mercaptal, amino, nitro, nitroso, sulfoxy and other groups.

The organic group or radical is preferably composed entirely of carbon and hydrogen, more preferably it is an aliphatic, cyclo aliphatic, or aromatic group or rather still more preferably an aliphatic group or radical, most preferably an alkyl group or radical.

Expressed as mmoles, the amount of non-ionic ashless antiwear additive present in the base stock oil ranges from about 0.065 to 650 mmoles, preferably about 0.065 to about 200 mmoles, more preferably about 0.65 to about 65 mmoles, most preferably about 0.65 to about 35 mmoles.

The preferred non-ionic ashless antiwear additives are those based on thiosalicylic acid (I), wherein preferably $R_1$ is $C_{14}$-$C_{20}$ alkyl, more preferably the $C_{18}$ alkyl substituted thiosalicylic acid. It is preferred that the antiwear additive comprise all or a portion of the non-ionic ashless antiwear additive but a quantity of conventional antiwear additives such as metal phosphate, metal thiophosphates, metal dialkyldithiophosphates, metal carbamates, metal thiocarbamates, metal dialkyldithiocarbamates and ashless antiwear additives such as ethoxylated amine dialkyldithiophosphate and ethoxylated amine dithiobenzoate can be present, preferably the metal alkyldithiophosphate, e.g., zinc dialkyldithiophosphates, the amount of non-ionic ashless antiwear additive to conventional antiwear additive on a mmole basis ranging from about 1:10 to 200:1, preferably about 1:10 to 100:1, more preferably about 1:10 to 50:1, most preferably about 1:10 to 10:1, and further in particular cases preferably about 1:1 to 10:1.

A preferred fully formulated wear resistant lubricant of the invention is prepared by blending or admixing with the base stock an additive package comprising an effective amount of at least one non-ionic, ashless antiwear additive, along with at least one additional performance enhancing additive, such as for example but not limited to at least one of a detergent, and/or a dispersant, and/or an antioxidant, and/or a pour point depressant, and/or a VI improver, and/or anti-wear agent, and/or extreme pressure additives and/or a friction modifier, and/or a demulsifier, and/or an antifoamant, and/or antiseizure agent, and/or a corrosion inhibitor, and/or lubricity agent, and/or a seal swell control additive, and/or dye, and/or metal deactivators, and/or antistaining agent. Of these, in addition to the non-ionic, ashless antiwear additives, those additives common to most formulated lubricating oils include a detergent, a dispersant, an antioxidant and a VI improver, with the others being optional depending on the intended use of the oil. An effective amount of at least one non-ionic, ashless antiwear additive and typically one or more additives, or an additive package containing at least one non-ionic, ashless antiwear additive and one or more such additives, is added to, blended into or admixed with the base stock to meet one or more specifications, such as those relating to a lube oil for an internal combustion engine crankcase, an automatic transmission, a turbine or jet, hydraulic oil, industrial oil, etc., as is known. For a review of many commonly used additives see: Klamann in "Lubricants and Related Products" Verlog Chemie, Deerfield Beach, FL: ISBN 0-89573-177-0 which also has a good discussion of a number of the lubricant additives identified above. Reference is also made to "Lubricant Additives" by M. W. Ronney, published by Noyes Data Corporation, Parkridge, N.J. (1973). Various manufacturers sell such additive packages for adding to a base stock or to a blend of base stocks to form fully formulated lube oils for meeting performance specifications required for different applications or intended uses, and the exact identity of the various additives present in an additive pack is typically maintained as a trade secret by the manufacturer. However, the chemical nature of the various additives is known to those skilled in the art. For example, alkali metal sulfonates and phenates are well known detergents, with PIBSA (polyisobutylene succinic anhydride) and PIBSA-PAM (polyisobutylene succinic anhydride amine) with or without being borated being well known and used dispersants. VI improvers and pour point depressants include acrylic polymers and copolymers such as polymethacrylates, polyalkylmethacrylates, as well as olefin copolymers, copolymers of vinyl acetate and ethylene, dialkyl fumarate and vinyl acetate, and others which are known. Friction modifiers include glycol esters and ether amines. Benzotriazole is a widely used corrosion inhibitor, while silicones are well known antifoamants. Antioxidants include hindered phenols and hindered aromatic amines such as 2,6-di-tert-butyl-4-n-butyl phenol and diphenyl amine, with copper compounds such as copper oleates and copper-PIBSA being well known. This is meant to be an illustrative, but nonlimiting list of the various additives used in lube oils. Thus, additive packages can and often do contain many different chemical types of additives. All of these additives are known and illustrative examples may be found, for example, in U.S. Pat. Nos. 5,352,374; 5,631,212; 4,764,294; 5,531,911 and 5,512,189.

A wide range of lubricating base oils is known in the art. Lubricating base oils that are useful in the present invention are natural oils, synthetic oils, and unconventional oils. Natural oil, synthetic oils, and unconventional oils and mixtures thereof can be used unrefined, refined, or rerefined (the latter is also known as reclaimed or reprocessed oil). Unrefined oils are those obtained directly from a natural, synthetic or unconventional source and used without further purification. These include for example shale oil obtained directly from retorting operations, petroleum oil obtained directly from primary distillation, and ester oil obtained directly from an esterification process. Refined oils are similar to the oils discussed for unrefined oils except refined oils are subjected to one or more purification or transformation steps to improve at least one lubricating oil property. One skilled in the art is familiar with many purification or transformation processes. These processes include, for example, solvent extraction, secondary distillation, acid extraction, base extraction, filtration, percolation, hydrogenation, hydrorefining, and hydrofinishing. Rerefined oils are obtained by processes analogous to refined oils, but use an oil that has been previously used.

Groups I, II, III, IV and V are broad categories of base oil stocks developed and defined by the American Petroleum Institute (API Publication 1509;www.API.org) to create guidelines for lubricant base oils. Group I base stocks generally have a viscosity index of between about 80 to 120 and contain greater than about 0.03% sulfur and/or less than about 90% saturates. Group II base stocks generally have a viscosity index of between about 80 to 120, and contain less than or equal to about 0.03% sulfur and greater than or equal to about 90% saturates. Group III stock generally has a viscosity index greater than about 120 and contains less than or equal to about 0.03 % sulfur and greater than about 90% saturates. Group IV includes polyalphaolefins (PAO). Group V base stocks include base stocks not included in Groups I-IV. Table A summarizes properties of each of these five groups.

TABLE A

Base Stock Properties

| | Saturates | Sulfur | Viscosity Index |
|---|---|---|---|
| Group I | <90% and/or | >0.03% and | ≧80 and <120 |
| Group II | ≧90% and | ≦0.03% and | ≧80 and <120 |
| Group III | ≧90% and | ≦0.03% and | ≧120 |
| Group IV | Polyalphaolefins (PAO) | | |
| Group V | All other base oil stocks not included in Groups I, II, III, or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful in the present invention. Natural oils vary also as to the method used for their production and purification, for example, their distillation range and whether they are straight run or cracked, hydrorefined, or solvent extracted.

Synthetic oils include hydrocarbon oils as well as non hydrocarbon oils. Synthetic oils can be derived from processes such as chemical combination (for example, polymerization, oligomerization, condensation, alkylation, acylation, etc.), where materials consisting of smaller, simpler molecular species are built up (i.e., synthesized) into materials consisting of larger, more complex molecular species. Synthetic oils include hydrocarbon oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stock is a commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064;and 4,827,073, which are incorporated herein by reference in their entirety.

The PAOs which are known materials and generally available on a major commercial scale from suppliers such as ExxonMobil Chemical Company, Chevron, BP-Amoco, and others, typically vary in number average molecular weight from about 250 to about 3000, or higher, and PAOs may be made in viscosities up to about 100 cSt (100° C.), or higher. In addition, higher viscosity PAOs are commercially available, and may be made in viscosities up to about 3000 cSt (100° C.), or higher. The PAOs are typically comprised of relatively low molecular weight hydrogenated polymers or oligomers of alphaolefins which include, but are not limited to, about $C_2$ to about $C_{32}$ alphaolefins with about $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of about $C_{14}$ to $C_{18}$ may be used to provide low viscosity base stocks of acceptably low volatility. Depending on the viscosity grade and the starting oligomer, the PAOs may be predominantly trimers and tetramers of the starting olefins, with minor amounts of the higher oligomers, having a viscosity range of about 1.5 to 12 cSt.

PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or U.S. Pat. No. 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122;and 5,068,487. All of the aforementioned patents are incorporated herein by reference in their entirety. The dimers of the $C_{14}$ to $C_{18}$ olefins are described in U.S. Pat. No. 4,218,330, also incorporated herein.

Other useful synthetic lubricating base stock oils such as silicon-based oil or esters of phosphorus containing acids may also be utilized. For examples of other synthetic lubricating base stocks are the seminal work "Synthetic Lubricants", Gunderson and Hart, Reinhold Publ. Corp., New York 1962, which is incorporated in its entirety.

In alkylated aromatic stocks, the alkyl substituents are typically alkyl groups of about 8 to 25 carbon atoms, usually from about 10 to 18 carbon atoms and up to about three such substituents may be present, as described for the alkyl benzenes in ACS Petroleum Chemistry Preprint 1053-1058, "Poly n-Alkylbenzene Compounds: A Class of Thermally Stable and Wide Liquid Range Fluids", Eapen et al, Phila. 1984. Tri-alkyl benzenes may be produced by the cyclodimerization of 1-alkynes of 8 to 12 carbon atoms as described in U.S. Pat. No. 5,055,626. Other alkylbenzenes are described in European Patent Application No. 168 534 and U.S. Pat. No. 4,658,072. Alkylbenzenes are used as lubricant base-stocks, especially for low-temperature applications (arctic vehicle service and refrigeration oils) and in papermaking oils. They are commercially available from producers of linear alkylbenzenes (LABs) such as Vista Chem. Co, Huntsman Chemical Co., Chevron Chemical Co., and Nippon Oil Co. Linear alkylbenzenes typically have good low pour points and low temperature viscosities and VI values greater than about 100, together with good solvency for additives. Other alkylated aromatics which may be used when desirable are described, for example, in "Synthetic Lubricants and High Performance Functional Fluids", Dressler, H., chap 5, (R. L. Shubkin (Ed.)), Marcel Dekker, N.Y. 1993. Each of the aforementioned references is incorporated herein by reference in its entirety.

Useful base stocks and base oils include base stocks and base oils derived from one or more Gas-to-Liquids (GTL) materials, slack waxes, natural waxes and the waxy stocks such as gas oils, waxy fuels hydrocracker bottoms, waxy raffinate, hydrocrackate, thermal crackates, or other mineral or non-mineral oil derived waxy materials, and mixtures of such base stocks.

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stocks and base oils include oils boiling on the lube oil boiling range separated from GTL materials such as by distillation, and subsequently subjected to well-known catalytic or solvent dewaxing processes to produce lube oils of low pour point; wax isomerates, comprising, for example, hydroisomerized or isodewaxed synthesized waxy hydrocarbons; Fischer-Tropsch (F-T) isomerates, comprising, for example, hydroisomerized or isodewaxed F-T material (i.e., hydrocarbons, waxy hydrocarbons, waxes and possible analogous oxygenates), preferably hydroisomerized or isodewaxed F-T waxy hydrocarbons or hydroisomerized or isodewaxed F-T waxes, hydroisomerized or isodewaxed synthesized waxes, or mixtures thereof. The term GTL base stocks and base oil further encompass the aforesaid base stocks and base oils in combination with other hydroisomerized or isodewaxed materials comprising for example, hydroisomerized or isodewaxed mineral/petroleum-derived hydrocarbons, hydroisomerized or isodewaxed waxy hydrocarbons, or mixtures thereof, derived from different feed materials including, for example, waxy distillates such as gas oils, waxy hydrocracked hydrocarbons, lubricating oils, high pour point polyalphaolefins, foots oil, normal alpha olefin waxes, slack waxes, deoiled waxes, and microcrystalline waxes.

GTL base stocks and base oils derived from GTL materials, especially, hydroisomerizedlisodewaxed F-T material derived base stocks and base oils, and other hydroisomerized/isodewaxed wax derived base stocks and base oils, such as slack wax isomerates are characterized typically as having kinematic viscosities at 100° C. of from about 2 cSt to about 50 cSt, preferably from about 3 cSt to about 30 cSt, more preferably from about 3.5 cSt to about 25 cSt, as exemplified by a GTL base stock derived by the isodewaxing of F-T wax, which has a kinematic viscosity of about 4 cSt at 100° C. and a viscosity index of about 130 or greater. Reference herein to Kinematic viscosity refers to a measurement made by ASTM method D445.

GTL base stocks and base oils derived from GTL materials, especially hydroisomerized/isodewaxed F-T material derived base stocks and base oils, and other hydroisomerized/isodewaxed wax-derived base stocks and base oils, such as slack wax hydroisomerates/isodewaxates are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step may be practiced to achieve the desired pour point. References herein to pour point refer to measurement made by ASTM D97 and similar automated versions.

The GTL base stocks and base oils derived from GTL materials, especially hydroisomerizedlisodewaxed F-T material derived base stocks and base oils, and other hydroisomerized/isodewaxed wax-derived base stocks and base oils, such as wax isomerate/isodewaxate which are components of this invention are also characterized typically as having viscosity indices of 80 or greater, preferably 100 or greater, and more preferably 120 or greater. Additionally, in certain particular instances, viscosity index of these base stocks may be preferably 130 or greater, more preferably 135 or greater, and even more preferably 140 or greater. For example, GTL base stocks and base oils that derived from GTL materials preferably F-T materials especially F-T wax generally have a viscosity index of 130 or greater. References herein to viscosity index refer to ASTM method D2270.

In addition, the GTL base stocks and base oils are typically highly paraffinic (>90 wt % saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than about 10 ppm, and more typically less than about 5 ppm of each of these elements. The sulfur and nitrogen content of GTL base stock and base oil obtained by the hydroisomerization/isodewaxing of F-T material, especially F-T wax is essentially nil.

Useful compositions of GTL base stocks and base oils, hydroisomerized or isodewaxed F-T material derived base stocks and base oils, and wax-derived hydroisomerized/isodewaxed base stocks and base oils, such as wax isomerates/isodewaxates, are recited in U.S. Pat. Nos. 6,080,301; 6,090,989, and 6,165,949 for example.

Wax isomerate/isodewaxate base stocks and base oils derived from other waxy feeds which are also suitable for use in this invention, are paraffinic fluids of lubricating viscosity derived from hydroisomerized or isodewaxed waxy feedstocks of mineral or natural source origin, e.g., feedstocks such as one or more of gas oils, slack wax, waxy fuels hydrocracker bottoms, hydrocarbon raffinates, natural waxes, hyrocrackates, thermal crackates or other suitable mineral or non-mineral oil derived waxy materials, linear or branched hydrocarbyl compounds with carbon number of about 20 or greater, preferably about 30 or greater, and mixtures of such isomerate/isodewaxate base stocks and base oils.

As used herein, the following terms have the indicated meanings:

"paraffinic" material: any saturated hydrocarbons, such as alkanes. Paraffinic materials may include linear alkanes, branched alkanes (iso-paraffins), cycloalkanes (cycloparaffins; mono-ring and/or multi-ring), and branched cycloalkanes;

"wax": hydrocarbonaceous material having a high pour point, typically existing as a solid at room temperature, at about 15° C. to 25° C., and consisting predominantly of paraffinic materials;

"hydroprocessing": a refining process in which a feedstock is heated with hydrogen at high temperature and under pressure, commonly in the presence of a catalyst, to remove and/or convert less desirable components and to produce an improved product;

"hydrotreating": a catalytic hydrogenation process that converts sulfur- and/or nitrogen-containing hydrocarbons into hydrocarbon products with reduced sulfur and/or nitrogen content, and which generates hydrogen sulfide and/or ammonia (respectively) as byproducts; similarly, oxygen containing hydrocarbons can also be reduced to hydrocarbons and water;

"hydrodewaxing" (or catalytic dewaxing): a catalytic process in which normal paraffins and/or waxy hydrocarbons are converted by cracking/fragmentation into lower molecular weight species, and/or by rearrangement/isomerization into more branched iso-paraffins;

"hydroisomerization" (or isodewaxing): a catalytic process in which normal paraffins and/or slightly branched iso-paraffins are converted by rearrangement/isomerization into more branched iso-paraffins;

"hydrocracking": a catalytic process in which hydrogenation accompanies the cracking/fragmentation of hydrocarbons, e.g., converting heavier hydrocarbons into lighter hydrocarbons, or converting aromatics and/or cycloparaffins (naphthenes) into non-cyclic branched paraffins.

As previously indicated, wax isomerate base stock and base oils suitable for use in the present invention, can be derived from other waxy feeds such as slack wax.

Slack wax is the wax recovered from petroleum oils by solvent or autorefrigerative dewaxing. Solvent dewaxing employs chilled solvent such as methyl ethyl ketone (MEK), methyl isobutyl ketone (MIBK), mixtures of MEK/MIBK, mixtures of MEK and toluene, while autorefrigerative dewaxing employs pressurized, liquefied low boiling hydrocarbons such as propane or butane to yield lube base oils/base stocks of reduced pour point.

Slack waxes, being secured from petroleum oils, may contain sulfur and nitrogen containing compounds. Such heteroatom compounds must be removed by hydrotreating (and not hydrocracking), as for example by hydrodesulfurization (HDS) and hydrodenitrogenation (HDN) so as to avoid subsequent poisoning/deactivation of the hydroisomerization catalyst.

In a preferred embodiment, the GTL material is a F-T material (i.e., hydrocarbons, waxy hydrocarbons, wax). A slurry F-T synthesis process may be beneficially used for synthesizing the feed from CO and hydrogen and particularly one employing a F-T catalyst comprising a catalytic cobalt component to provide a high alpha for producing the more desirable higher molecular weight paraffins. This process is also well known to those skilled in the art.

In a F-T synthesis process, a synthesis gas comprising a mixture of $H_2$ and CO is catalytically converted into hydrocarbons and preferably liquid hydrocarbons. The mole ratio of the hydrogen to the carbon monoxide may broadly range from about 0.5 to 4, but which is more typically within the range of from about 0.7 to 2.75 and preferably from about 0.7 to 2.5. As is well known, F-T synthesis processes include processes in which the catalyst is in the form of a fixed bed, a fluidized bed or as a slurry of catalyst particles in a hydrocarbon slurry liquid. The stoichiometric mole ratio for a F-T synthesis reaction is 2.0, but there are many reasons for using other than a stoichiometric ratio as those skilled in the art know. In a cobalt slurry hydrocarbon synthesis process the feed mole ratio of the $H_2$ to CO is typically about 2.1/1. The synthesis gas comprising a mixture of $H_2$ and CO is bubbled up into the bottom of the slurry and reacts in the presence of the particulate F-T synthesis catalyst in the slurry liquid at conditions effective to form hydrocarbons, a portion of which are liquid at the reaction conditions and which comprise the hydrocarbon slurry liquid. The synthesized hydrocarbon liquid is separated from the catalyst particles as filtrate by means such as filtration, although other separation means such as centrifugation can be used. Some of the synthesized hydrocarbons pass out the top of the hydrocarbon synthesis reactor as vapor, along with unreacted synthesis gas and other gaseous reaction products. Some of these overhead hydrocarbon vapors are typically condensed to liquid and combined with the hydrocarbon liquid filtrate. Thus, the initial boiling point of the filtrate may vary depending on whether or not some of the condensed hydrocarbon vapors have been combined with it. Slurry hydrocarbon synthesis process conditions vary somewhat depending on the catalyst and desired products.

Typical conditions effective to form hydrocarbons comprising mostly $C_{5+}$ paraffins, (e.g., $C_{5+}$-$C_{200}$) and preferably $C_{10+}$ paraffins, in a slurry hydrocarbon synthesis process employing a catalyst comprising a supported cobalt component include, for example, temperatures, pressures and hourly gas space velocities in the range of from about 320-850° F., 80-600 psi and 100-40,000 V/hr/V, expressed as standard volumes of the gaseous CO and $H_2$ mixture (0° C., 1 atm) per hour per volume of catalyst, respectively. It is preferred that the hydrocarbon synthesis reaction be conducted under conditions in which limited or no water gas shift reaction occurs and more preferably with no water gas shift reaction occurring during the hydrocarbon synthesis. It is also preferred to conduct the reaction under conditions to achieve an alpha of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. Those skilled in the art know that by alpha is meant the Schultz-Flory kinetic alpha. While suitable F-T reaction types of catalyst comprise, for example, one or more Group VIII catalytic metals such as Fe, Ni, Co, Ru and Re, it is preferred that the catalyst comprise a cobalt catalytic component. In one embodiment the catalyst comprises catalytically effective amounts of Co and one or more of Re, Ru, Fe, Ni, Th, Zr, Hf, U, Mg and La on a suitable inorganic support material, preferably one which comprises one or more refractory metal oxides. Preferred supports for Co containing catalysts comprise titania, particularly. Useful catalysts and their preparation are known and illustrative, but nonlimiting examples may be found, for example, in U.S. Pat. Nos. 4,568,663; 4,663,305; 4,542,122; 4,621,072 and 5,545,674.

As set forth above, the waxy feed from which a preferred base stock is derived comprises mineral wax or other natural source wax, especially slack wax, or waxy F-T material, referred to as F-T wax. F-T wax preferably has an initial boiling point in the range of from 650-750° F. and preferably continuously boils up to an end point of at least 1050° F. A narrower cut waxy feed may also be used during the hydroisomerization. A portion of the n-paraffin waxy feed is converted to lower boiling isoparaffinic material. Hence, there must be sufficient heavy n-paraffin material to yield an isoparaffin containing isomerate boiling in the lube oil range. If catalytic dewaxing is also practiced after hydroisomerization to reduce or further reduce the pour point, some of the isomerate will also be converted to lower boiling material during the dewaxing. Hence, it is preferred that the end boiling point of the waxy feed subjected to hydroisomerization be above 1050° F. (1050° F.+).

The waxy feed subjected to hydroisomerization preferably comprises the entire 650-750° F.+ fraction formed by the hydrocarbon synthesis process, with the initial cut point between 650° F. and 750° F. being determined by the practitioner and the end point, preferably above 1050° F., determined by the catalyst and process variables employed by the practitioner for the synthesis. Waxy feeds may be processed as the entire fraction or as subsets of the entire fraction prepared by distillation or other separation techniques. The waxy feed also typically comprises more than 90 wt %, generally more than 95 wt % and preferably more than 98 wt % paraffinic hydrocarbons, most of which are normal paraffins. It has negligible amounts of sulfur and nitrogen compounds (e.g., less than 1 wppm of each), with less than 2,000 wppm, preferably less than 1,000 wppm and more preferably less than 500 wppm of oxygen, in the form of oxygenates. Waxy feeds having these properties and useful in the process of the invention have been made using a slurry F-T process with a catalyst having a catalytic cobalt component, as previously indicated.

The process of making the lubricant oil base stocks from waxy stocks, e.g., slack wax or F-T wax, may be characterized as a hydrodewaxing process. If slack waxes are used as the feed, they may need to be subjected to a preliminary hydrotreating step under conditions already well known to those skilled in the art to reduce (to levels that would effectively avoid catalyst poisoning or deactivation) or to remove sulfur- and nitrogen-containing compounds which would otherwise deactivate the hydroisomerization/hydrodewaxing catalyst used in subsequent steps. If F-T waxes are used, such preliminary treatment is not required because, as indicated above, such waxes have only trace amounts (less than about 10 ppm, or more typically less than about 5 ppm to nil) of sulfur or nitrogen compound content. However, some hydrodewaxing catalyst fed F-T waxes may benefit from removal of oxygenates while others may benefit from oxygenates treatment. The hydrodewaxing process may be conducted over a combination of catalysts, or over a single catalyst. Conversion temperatures range from about 150° C. to about 500° C. at pressures ranging from about 500 to 20,000 kPa. This process may be operated in the presence of hydrogen, and hydrogen partial pressures range from about 600 to 6000 kPa. The ratio of hydrogen to the hydrocarbon feedstock (hydrogen circulation rate) typically range from about 10 to 3500 n.l.l.$^{-1}$ (56 to 19,660 SCF/bbl) and the space velocity of the feedstock typically ranges from about 0.1 to 20 LHSV, preferably 0.1 to 10 LHSV.

Following any needed hydrodenitrogenation or hydrodesulfurization, the hydroprocessing used for the production of base stocks from such waxy feeds may use an amorphous hydrocracking/hydroisomerization catalyst, such as a lube hydrocracking (LHDC) catalysts, for example catalysts containing Co, Mo, Ni, W, Mo, etc., on oxide supports, e.g., alumina, silica, silica/alumina, or a crystalline hydrocracking/hydroisomerization catalyst, preferably a zeolitic catalyst.

Other isomerization catalysts and processes for hydrocracking/hydroisomerized/isodewaxing GTL materials and/or waxy materials to base stock or base oil are described, for example, in U.S. Pat. Nos. 2,817,693; 4,900,407; 4,937,399; 4,975,177; 4,921,594; 5,059,299; 5,200,382; 5,516,740; 5,182,248; 5,290,426; 5,580,442; 5,976,351; 5,935,417; 5,885,438; 5,965,475; 6,190,532; 6,375,830; 6,332,974; 6,103,099; 6,025,305; 6,080,301;6,096,940; 6,620,312; 6,676,827; 6,383,366; 6,475,960; 5,059,299; 5,977,425; 5,935,416; 4,923,588; 5,158,671;and 4,897,178;EP 0324528 (B1), EP 0532116 (B1), EP 0532118 (B1), EP 0537815 (B 1), EP 0583836 (B2), EP 0666894 (B2), EP 0668342 (B1), EP 0776959 (A3), WO 97/031693 (A1), WO 02/064710 (A2), WO 02/064711 (A1), WO 02/070627 (A2), WO 02/070629 (A1), WO 03/033320 (A1) as well as in British Patents 1,429,494; 1,350,257; 1,440,230; 1,390,359;WO 99/45085 and WO 99/20720. Particularly favorable processes are described in European Patent Applications 464546 and 464547. Processes using F-T wax feeds are described in U.S. Pat. Nos. 4,594,172; 4,943,672; 6,046,940; 6,475,960; 6,103,099; 6,332,974;and 6,375,830.

Hydrocarbon conversion catalysts useful in the conversion of the n-paraffin waxy feedstocks disclosed herein to form the isoparaffinic hydrocarbon base oil are zeolite catalysts, such as ZSM-5, ZSM-11, ZSM-23, ZSM-35, ZSM-12, ZSM-38, ZSM-48, offretite, ferrierite, zeolite beta, zeolite theta, zeolite alpha, as disclosed in U.S. Pat. No. 4,906,350. These catalysts are used in combination with Group VIII metals, in particular palladium or platinum. The Group VIII metals may be incorporated into the zeolite catalysts by conventional techniques, such as ion exchange.

In one embodiment, conversion of the waxy feedstock may be conducted over a combination of Pt/zeolite beta and Pt/ZSM-23 catalysts in the presence of hydrogen. In another embodiment, the process of producing the lubricant oil base stocks comprises hydroisomerization and dewaxing over a single catalyst, such as Pt/ZSM-35. In yet another embodiment, the waxy feed can be isodewaxed over Group VIII metal loaded ZSM-48, preferably Group VIII noble metal loaded ZSM-48, more preferably Pt/ZSM-48 in either one stage or two stages. In any case, useful hydrocarbon base oil products may be obtained. Catalyst ZSM-48 is described in U.S. Pat. No. 5,075,269, the disclosure of which is incorporated herein by reference. The use of the Group VIII metal loaded ZSM-48 family of catalysts, preferably platinum on ZSM-48 in the isodewaxing of the waxy feedstock eliminates the need for any subsequent, separate dewaxing step, and is preferred.

A dewaxing step, when needed, may be accomplished using either well known solvent or catalytic dewaxing processes. In solvent dewaxing, all or a part of the hydroisomerate may be contacted with chilled solvents such as acetone, methyl ethyl ketone (MEK), methyl isobutyl ketone (MIBK), mixtures of MEK/MIBK, or mixtures of MEK/toluene and the like, and further chilled to precipitate out the higher pour point material as a waxy solid which is then separated from the solvent-containing lube oil fraction which is the raffinate. The raffinate is typically further chilled in scraped surface chillers to remove more wax solids. Low molecular weight hydrocarbons, such as propane or butane, are also used for dewaxing, in which the hydroisomerate is mixed with liquid propane or butane, at least a portion of which is flashed off to chill down the hydroisomerate to precipitate out the wax. The wax is separated from the raffinate by filtration, membrane separation or centrifugation. The solvent is then stripped out of the raffinate, which is then fractionated if necessary to produce the preferred base stocks useful in the present invention. Also well known is catalytic dewaxing, in which all or part of the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling materials, in the boiling range, for example, 650-750° F.−, which are separated from the heavier 650-750° F.+ base stock fraction and the base stock fraction fractionated into two or more base stocks. Separation of the lower boiling material may be accomplished either prior to or during fractionation of the 650-750° F.+ material into the desired base stocks.

Any dewaxing catalyst which will reduce the pour point of the hydroisomerate, if necessary, and preferably those which provide a large yield of lube oil base stock from the hydroisomerate may be used. These include shape selective molecular sieves which, when combined with at least one catalytic metal component, have been demonstrated as useful for dewaxing petroleum oil fractions and include, for example, ferrierite, mordenite, ZSM-5, ZSM-11, ZSM-23, ZSM-35, ZSM-22 also known as theta one or TON, and the silicoaluminophosphates known as SAPO's. A dewaxing catalyst which has been found to be unexpectedly particularly effective comprises a noble metal, preferably Pt, composited with H-mordenite. The dewaxing may be accomplished with the catalyst in a fixed, fluid or slurry bed. Typical dewaxing conditions include a temperature in the range of from about 400-600° F., a pressure of 500-900 psig, $H_2$ treat rate of 1500-3500 SCF/B for flow-through reactors and LHSV of 0.1-10, preferably 0.2-2.0. The dewaxing is typically conducted to convert no more than 40 wt % and preferably no more than 30 wt % of the hydroisomerate having an initial boiling point in the range of 650-750° F. to material boiling below its initial boiling point.

GTL base stocks and base oils, hydroisomerized or isodewaxed wax-derived base stocks and base oils, have a beneficial kinematic viscosity advantage over conventional Group II and Group III base stocks and base oils, and so may be very advantageously used with the instant invention. Such GTL base stocks and base oils can have significantly higher kinematic viscosities, up to about 20-50 cSt at 100° C., whereas by comparison commercial Group II base oils can have kinematic viscosities, up to about 15 cSt at 100° C., and commercial Group III base oils can have kinematic viscosities, up to about 10 cSt at 100° C. The higher kinematic viscosity range of GTL base stocks and base oils, compared to the more limited kinematic viscosity range of Group II and Group III base stocks and base oils, in combination with the instant invention can provide additional beneficial advantages in formulating lubricant compositions.

In the present invention the GTL base stock/base oil, or the wax hydroisomerate/isodewaxate oil, can constitute all or part of the base stock oil.

One or more of these wax isomerate/isodewaxate base stocks and base oils can be used as such or in combination with the GTL base stocks and base oils.

One or more of these waxy feed derived base stocks and base oils, derived from GTL materials and/or other waxy feed materials can similarly be used as such or further in combination with other base stock and base oils of mineral oil origin, natural oils and/or with synthetic base oils.

The preferred base stocks or base oils derived form GTL materials and/or from waxy feeds are characterized as having predominantly paraffinic compositions and are further characterized as having high saturates levels, low-to-nil sulfur, low-to-nil nitrogen, low-to-nil aromatics, and are essentially water-white in color.

The GTL base stock/base oil and/or wax hydroisomerate/isodewaxate, preferably GTL base oils/base stocks obtained by the hydroisomerization of F-T wax, more preferably GTL base oils/base stocks obtained by the isodewaxing of F-T wax, can constitute from 5 to 100 wt %, preferably 40 to 100 wt %, more preferably 70 to 100 wt % by weight of the total of the base oil, the amount employed being left to the practitioner in response to the requirements of the finished lubricant.

The low sulfur and nitrogen content of Gas-to-Liquids (GTL) base oils, in combination with the instant invention can provide additional advantages in lubricant compositions where very low overall sulfur content can beneficially impact lubricant performance.

GTL base oils and base oils derived from synthesized hydrocarbons, for example, hydroisomerized or isodewaxed waxy synthesized hydrocarbon, e.g., F-T waxy hydrocarbon base oils are of low or zero sulfur and phosphorus content. There is a movement among original equipment manufacturers and oil formulators to produce formulated oils of ever increasingly reduced sulfur, sulfated ash and phosphorus content to meet ever increasingly restrictive environmental regulations. Such oils, known as low SAP oils, would rely on the use of base oils which themselves, inherently, are of low or zero initial sulfur and phosphorus content. Such oils when used as base oils can be formulated with low ash additives and even if the additive or additives contain sulfur and/or phosphorus the resulting formulated oils will be low SAP.

Low SAP formulated oils for automotive engines (both spark ignited and compression ignited) will have a sulfur content of 0.7 wt % or less, preferably 0.6 wt % or less, more preferably 0.5 wt % or less, most preferably 0.4 wt % or less, an ash content of 1.2 wt % or less, preferably 0.8 wt % or less, more preferably 0.4 wt % or less, and a phosphorus content of 0.18% or less, preferably 0.1 wt % or less, more preferably 0.09 wt % or less, most preferably 0.08 wt % or less, and in certain instances, even preferably 0.05 wt % or less.

Alkylene oxide polymers and interpolymers and their derivatives containing modified terminal hydroxyl groups obtained by, for example, esterification or etherification are useful synthetic lubricating oils. By way of example, these oils may be obtained by polymerization of ethylene oxide or propylene oxide, the alkyl and aryl ethers of these polyoxyalkylene polymers (methyl-polyisopropylene glycol ether having an average molecular weight of about 1000, diphenyl ether of polyethylene glycol having a molecular weight of about 500-1000, and the diethyl ether of polypropylene glycol having a molecular weight of about 1000 to 1500, for example) or mono- and polycarboxylic esters thereof (the acidic acid esters, mixed $C_{3-8}$ fatty acid esters, or the $C_{13}$Oxo acid diester of tetraethylene glycol, for example).

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, lo fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols (preferably the hindered polyols such as the neopentyl polyols e.g. neopentyl glycol, trimethylol ethane, 2-methyl-2-propyl-1,3-propanediol, trimethylol propane, pentaerythritol and dipentaerythritol) with alkanoic acids containing at least about 4 carbon atoms (preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid).

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms.

Silicon-based oils are another class of useful synthetic lubricating oils. These oils include polyalkyl-, polyaryl-, polyalkoxy-, and polyaryloxy-siloxane oils and silicate oils. Examples of suitable silicon-based oils include tetraethyl silicate, tetraisopropyl silicate, tetra-(2-ethylhexyl)silicate, tetra-(4-methylhexyl) silicate, tetra-(p-tert-butylphenyl) silicate, hexyl-(4-methyl-2-pentoxy) disiloxane, poly(methyl) siloxanes, and poly-(methyl-2-mehtylphenyl) siloxanes.

Another class of synthetic lubricating oil is esters of phosphorous-containing acids. These include, for example, tricresyl phosphate, trioctyl phosphate, diethyl ester of decane-phosphonic acid.

Another class of oils includes polymeric tetrahydrofurans, their derivatives, and the like.

Other useful fluids of lubricating viscosity include non-conventional or unconventional base stocks that have been processed, preferably catalytically, or synthesized to provide high performance lubrication characteristics.

In many cases it will be advantageous to employ only a GTL base stock/base oil such as one derived from waxy F-T hydrocarbons for a particular wear resistant lubricant, while in other cases one or more additional base stocks may be mixed with, added to or blended with one or more of the GTL base stocks/base oils, e.g., F-T derived base stocks. Such additional base stocks may be selected from the group consisting of (i) natural base stock, (ii) synthetic base stock, (iii) unconventional base stock and mixtures thereof.

Further, because it has been unexpectedly found that a lube oil formulation containing GTL base stocks/base oil or base oils derived from slack wax or waxy GTL materials, preferably F-T hydrocarbons, by hydroisomerization or isodewaxing and non-ionic ashless antiwear additives exhibits antiwear performance superior even to that exhibited by other base oils when combined with the non-ionic ashless antiwear additive it is preferred that the lubricating oil formulation comprise a base stock which comprises a substantial portion of one or more GTL base stock/base oil or base stock, and/or base stock/base oil derived from slack wax or waxy GTL material, preferably F-T hydrocarbons, by hydroisomerization. If a base stock blend is used it should contain at least 5 wt %, preferably at least 40 wt %, more preferably at least 70 wt %, most preferably at least 80 wt % of the GTL base stock/base oil, or slack wax or GTL material base stock derived by hydroisomerization, preferably F-T base stock derived by hydroisomerization. As is readily apparent, any formulated oil utilizing such a blend, while exhibiting performance superior to that secured when such other base stock is used exclusively, will be inferior in performance to that achieved when GTL base stocks/base oils or GTL material, preferably F-T wax, base stock derived by hydroisomerization, or mixture thereof is the only base stock employed.

Advantage can be taken of the present invention in formulating low sulfur, low ash and low phosphorus lubricating oil compositions to met the latest lubricant requirements of the OEM's.

EXAMPLES

In the following examples, in order to make the comparisons truly representative of the antiwear performance attributable to the additives tested, the amounts of the additives used are reported in both wt % and in mmole. While the amounts of each additive used varied widely in terms of wt % used, the amounts employed in terms of mmoles were held at the 0.65, 1.95, 3.25, 4.55 and 6.5 mmole levels facilitating comparisons between the different additives at equivalent treat levels.

Example 1

Wear tests were conducted on seven different lubricating oil base stocks both without any antiwear additive with different levels of non-ionic ashless antiwear additive, thiosalicylic acid. The tests were all conducted in a High Frequency Reciprocating Rig (HFRR) test (ISO Provisional Standard, TC22/SC7N959, 1995). This test is designed to predict wear performance of diesel fuels. A modified procedure was developed to evaluate the wear characteristics of basestocks with and without antiwear additive. Test conditions include Time=200 minutes; Load=1 kg; Frequency=20 Hz; and Temperature=120° C. In this test, the wear scar diameter of a loaded steel ball is the measure of the wear performance of the lubricant. The repeatability of the HFRR test is ±1.0 to 2.0%.

The lubricating oil base stocks used in the following examples and comparative examples had the following characteristics:

TABLE 1

| Characteristic | Test Method (ASTM) | GTL 6 | PAO 4 | PAO 6 | Group I | Group II | 4 cSt Group III (A) | 6 cSt Group III (A) | 6 cSt Group III (B) |
|---|---|---|---|---|---|---|---|---|---|
| Pour Point, ° C. | D97 | −18 | <−54 | <−54 | −12 | −18 | −18 | −18 | −18 |
| KV cSt @ 40° C. | D445 | 29.7 | 18.8 | 30.2 | 31.0 | 30.1 | — | — | — |
| KV cSt @ 100° C. | D445 | 6.0 | 4.2 | 5.8 | 5.3 | 5.5 | 4.0 | 6.6 | 6.1 |
| VI | D2270 | 157 | 127 | 139 | 98 | 118 | 142 | 147 | 130 |
| Noack volatility wt % | D5800 | 6.9 | 15.85 | 7.7 | 14 | 14 | 15.0 | 7.6 | 6.9 |
| CCS viscosity | D5293 | | | | | | | | |
| @ −20° C. cP | | 890 | | | 2200 | | — | — | — |
| @ −25° C. cP | | 2290 | | | 4230 | 2410 | | | |
| @ −30° C. cP | | | | | 9660 | 4530 | | | |
| @ −35° C. cP | | 4110 | 1510 | 3932 | 22174 | 9140 | 1354 | 7230 | 8380 |
| Flash point, COC ° C. | D92 | 232 | 224 | 240 | 228 | 224 | 220 | 248 | 232 |
| Density @ 15° C. kg/l | D4052 | 0.822 | 0.8205 | 0.8266 | 0.8701 | 0.8529 | 0.8170 | 0.8353 | 0.8422 |
| Sulfur, ppm | D2622 | (0) | (0) | (0) | 176 | 1.2 | 0 | 0 | 10 |

(A) Group III stock which is a slack wax isomerate according to WO 03/33320

(B) Group III stock which is a hydrocracked, isomerized base oil made using a catalytic isodewaxing process according to USP 5,580,442

The GTL liquid base stock in these examples is made from a synthesized F-T waxy hydrocarbon produced from CO and H which is isodewaxed using a Pt/ZSM-48 catalyst.

Tables 2-8 (below) report the relative wear scar diameter (microns) of the test compositions.

As shown in Table 2 below, all formulations when additized with thiosalicylic acid (unsubstituted) showed improved wear performance, with the GTL base oil (GTL 6)/additive blend showing an even higher level of wear performance improvement. While the wear scar diameter is higher in both PAO/additive blends and the Group I, Group II and Group III base oil/additive blends, especially at low (<0.01 wt %) and high (>0.05 wt %) treat rates of the ashless antiwear additive as compared against the GTL base oil/additive blend or Group III(A) base oil/additive blend, the wear performance is still improved relative to the examples of each oil which used no additive. Advantages at lower treat rates allow for the reduced use of antiwear additive and advantages at higher treat rates allowed for the maximization of antiwear performance in GTL base oils or F-T wax isomerate base oils.

TABLE 2

| | Thiosalicylic Acid | | | | | |
|---|---|---|---|---|---|---|
| Wt % Mmol | No Additive | 0.01 0.65 | 0.03 1.95 | 0.05 3.25 | 0.07 4.55 | 0.10 6.50 |
| | Average of 3 Runs | | | | | |
| GTL 6 | 418 | 404 | 435* | 402 | 337 | — |
| PAO 4 | 528 | 483 | 409* | 425 | 434 | — |
| PAO 6 | 486 | 524 | 441 | 434 | — | 418 |
| | Average of 5 Runs | | | | | |
| Group I | 422 | 415 | 369 | 403 | 375 | 412 |
| Group II | 454 | 398 | 375 | — | 333 | 367 |
| 6 cSt Group III (B) | 434 | 459 | 375 | 375 | 354 | 400 |
| 6 cSt Group III (A) | 606 | 410 | 420 | 342 | 354 | 414 |

*These results are attributed to experimental variation

Example 2

Wear tests were conducted on two different lube base stocks both without any antiwear additive and with different levels of the non-ionic ashless antiwear additive thiazolidine (unsubstituted). The HFRR test was conducted as outlined in Example 1, above.

As is shown in Table 3 below, while both base stocks showed an improvement in wear performance when combined with thiazolidine, the GTL base oil/thiazolidine blend showed unexpectedly superior result in wear performance as compared against the result secured in the case of PAO-6 and thiazolidine, over the entire range of thiazolidine used. Though improved over the base case of no additive, the wear scar diameter is noticeably higher in the case of the PAO/additive blend.

TABLE 3

| | Thiazolidine | | | | | |
|---|---|---|---|---|---|---|
| Wt % mmol | No Additive | 0.005 0.65 | 0.015 1.95 | 0.025 3.25 | 0.035 4.55 | 0.050 6.50 |
| GTL 6 | 418 | 433 | 420 | 417 | 387 | 366 |
| PAO 6 | 486 | 498 | 460 | 442 | 430 | 426 |

Example 3

Wear tests were conducted on five different lubricating base stocks both without any antiwear additive and with different levels of the non-ionic ashless antiwear additive thioxomalonate (diethylthioxomalonate, $R^3$ and $R^4$ in Formula II are both ethyl, $C_2H_5$), under the HFRR list conditions outlined above. In all instances, as shown in Table 4, the formulations showed an improvement in wear performance, the formulations comprising the slack wax isomerate base oil/thioxomalonate additive or the GTL base oil/thioxomalonate additive, at all additive treat levels showing superior improvement in wear performance as compared against formulations which employed PAO-6 or Group I, Group II or Group III base stocks.

TABLE 4

| | Thioxomalonate | | | | | |
|---|---|---|---|---|---|---|
| Wt % mmol | No Additive | 0.012 0.65 | 0.037 1.95 | 0.062 3.25 | 0.087 4.55 | 0.12 6.50 |
| GTL 6 | 418 | 410 | 406 | 400 | 376 | 365 |
| PAO 6 | 486 | 484 | 465 | 440 | 422 | 410 |
| Group I | 422 | 482 | | | 431 | |
| Group II | 434 | 470 | | | 426 | |
| 6 cSt Group III**(A) | 606 | 441 | | | 420 | |

Comparative Example 1

Wear tests were conducted on three different basestocks without any antiwear additive and with different levels of the conventional ionic ashless antiwear additive ethoxylated amine dialkyldithiophosphate disclosed in U.S. Pat. No. 6,165,949 and under the HFRR test conditions outlined above.

As is shown in Table 5, this conventional ionic ashless antiwear agent performs relatively equivalently in both the GTL base oil and in PAO 4 and PAO 6. While at the treat levels of 1.95 mmol and higher the GTL base oil/ethoxylated amine DDP blend exhibited some degree of improved antiwear performance as compared against the PAO 4 and PAO 6/ethoxylated amine DDP blend, the difference in performance was not as significant and pronounced as was demonstrated for the base oil/non-ionic ashless anti-wear additive and GTL base oil/non-ionic ashless antiwear additive blends as demonstrated in Examples 1, 2 and 3 (Tables 2, 3 and 4). As is seen by comparing the present results with those of Table 2, it took 6.5 mmoles of ethoxylated amine DDP to produce a level of wear scar reduction which was higher than that achieved using only 0.65 mmoles of C18 thiosalicylic acid indicating that the alkyl substituted thiosalicylic acid non-ionic ashless antiwear additive is unexpectedly superior in performance as an antiwear additive as compared to the heretofore known and described ionic ashless antiwear additive. As compared against the thiazolidine non-ionic ashless antiwear additive Table 3 it took only 0.65 mmoles of the thiazolidene antiwear additive to achieve the same level of wear scar reduction as ten times as much(6.5 mmoles)ethoxylated amine DDP additive. With respect to Table 4, 0.65 mmoles of thioxomalonate non-ionic ashless antiwear agent unexpectedly achieve equivalent or superior antiwear performance as compared against ten times as much (6.5 mol) of the conventional ethoxylated amine DDP additive in the base oils tested.

TABLE 5

| | Ethoxylated Amine DDP | | | | | | |
|---|---|---|---|---|---|---|---|
| Wt % | No | 0.051 | 0.153 | 0.225 | 0.357 | 0.550 | 1.00 |
| mmol | Additive | 0.65 | 1.95 | 3.25 | 4.55 | 6.50 | — |
| GTL 6 | 418 | 603 | 569 | 530 | 496 | 430 | 395 |
| PAO 4 | 528 | 622 | 603 | 588 | 525 | 466 | 450 |
| PAO 6 | 486 | 590 | 607 | 560 | 534 | 470 | 428 |

Example 4

Wear scan testing was conducted on two different basestock both without any antiwear additive, with 0.65 mmol of ZDDP and with different levels of non-ionic ashless antiwear additives in combination with a 0.65 mmols of ZDDP. The HFRR tests were conducted under the conditions outlined above.

As shown in Tables 6 and 7 the combination of the non-ionic ashless antiwear additive with the ZDDP resulted in a reduction in the wear scar exhibited in all listed formulations, but in the case of the GTL base oil formulation the reduction far exceeded that observed in the case of the PAO-6 based formulations.

Further, the combination of the ZDDP with the non-ionic ashless antiwear additive produced a reduction in the wear scaring far greater than that achieved for formulations containing just the non-ionic ashless antiwear additive (Tables 2 and 3) and this despite the fact that the formulations containing just the ZDDP exhibited far higher wear scaring a compared against the C18 thiosalicylic acid or thioxomalonate non-ionic ashless antiwear agent containing formulations.

TABLE 6

| | Thiosalicylic Acid, Plus ZDDP | | | | |
|---|---|---|---|---|---|
| Wt % | No | 0.01 + 0.043 | 0.03 + 0.043 | 0.05 + 0.043 | Just ZDDP 0.043 |
| mmol | Additive | 0.65 + 0.65 | 1.95 + 0.65 | 3.25 + 0.65 | 0.65 |
| GTL 6 | 418 | 386 | 323 | 295 | 502 |
| PAO 6 | 486 | 466 | 402 | 356 | 536 |

TABLE 7

| | Thioxomalonate Plus ZDDP | | | | |
|---|---|---|---|---|---|
| Wt % | No | 0.012 + 0.043 | 0.037 + 0.043 | 0.062 + 0.043 | Just ZDDP 0.043 |
| mmol | Additive | 0.65 + 0.65 | 1.95 + 0.65 | 3.25 + 0.65 | 0.65 |
| GTL 6 | 418 | 395 | 362 | 302 | 502 |
| PAO 6 | 486 | 452 | 394 | 341 | 536 |

Example 5

Wear scar testing was conducted on two different basestocks both without any antiwear additive, with 0.65 mmol ZDDP and with different levels of ethoxylated amine DDP ashless antiwear additives in combination with a constant amount of 0.65 mmol ZDDP.

As shown in Table 8, the combination of the ZDDP with the ethoxylated amine DDP while reducing the wear scaring as compared to formulations containing just ethoxylated amine DDP did not result in as significant and dramatic a change as exhibited by those formulations containing the non-ionic ashless antiwear additive plus ZDDP.

TABLE 8

| | Ethoxylated Amine DDP, Plus ZDDP | | | | |
|---|---|---|---|---|---|
| Wt % | No | 0.051 + 0.043 | 0.153 + 0.043 | 0.225 + 0.043 | Just ZDDP 0.043 |
| mmol | Additive | 0.65 + 0.65 | 1.95 + 0.65 | 3.25 + 0.65 | 0.65 |
| GTL 6 | 418 | 578 | 542 | 497 | 502 |
| PAO 6 | 486 | 610 | 574 | 509 | 536 |

Example 6

The HFRR test also produces specific results with respect to the average friction coefficient of the blend during the test. In the ashless antiwear additive study, GTL base oil displays improvement in friction coefficients when compared to PAO 4, PAO 6, 4 cSt Gp III$^{(A)}$, 6 cSt Gp III$^{(A)}$, and 6 cSt Gp III$^{(B)}$, especially at low (<0.03%) and high (>0.05%) treat rates of the non-ionic C18 thiosalicylic acid ashless antiwear additive (see Table 9). Advantages at lower treat rates allow for the use of reduced levels of antiwear additive. Advantages at higher treat rates allow for the maximization of friction performance in GTL base oil blends.

TABLE 9

| | Average Friction Coefficient | | | | | |
|---|---|---|---|---|---|---|
| | 0.00% | 0.01% | 0.03% | 0.05% | 0.07% | 0.10% |
| GTL 6 | 0.138 | 0.120 | 0.140 | 0.129 | 0.090 | |
| PAO 4 | 0.160 | 0.114 | 0.133 | 0.132 | 0.135 | |
| PAO 6 | 0.153 | 0.163 | 0.140 | 0.134 | | 0.126 |
| 4 cSt Gp III$^{(A)}$ | 0.152 | 0.150 | 0.124 | 0.148 | | 0.119 |
| 6 cSt Gp III$^{(A)}$ | 0.150 | 0.129 | 0.127 | 0.111 | | 0.116 |
| 6 cSt Gp III$^{(B)}$ | 0.138 | 0.148 | 0.122 | 0.121 | | 0.125 |

What is claimed is:

1. A wear resistant lubricant formulation comprising a base oil selected from the group consisting of GTL base stock/base oil or a base oil derived from waxy hydrocarbon stock, slack wax or waxy paraffinic Fischer-Tropsch hydrocarbons by hydroisomerization or isodewaxing and mixtures thereof boiling in the lube oil boiling range in admixture with an effective amount of at least one non-ionic ashless antiwear additive selected from the group consisting of (II), (III), and IV;

II

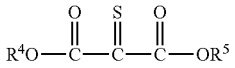

wherein $R^4$ and $R^5$ are the same or different and are selected from organic groups having from 1-20 carbons;

III

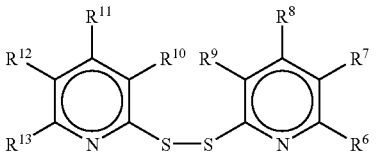

wherein $R^6$ to $R^{13}$ are the same or different and are selected from hydrogen and organic groups having 1 to 20 carbons; and

IV

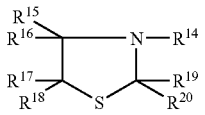

wherein $R^{14}$-$R^{20}$ are the same or different and are selected from hydrogen and organic groups having 1 to 20 carbons.

2. The wear resistant lubricant formulation of claim 1 wherein the base oil is derived from slack wax or waxy F-T hydrocarbons by hydroisomerization followed by dewaxing selected from catalytic dewaxing and solvent dewaxing.

3. The wear resistant lubricant formulation of claim 1 wherein the base oil is derived from slack wax or waxy Fisher-Tropsch hydrocarbons by isodewaxing.

4. The wear resistant lubricant formulation of claim 3 wherein the base oil is derived from slack wax or waxy F-T hydrocarbons by isodewaxing using a Group VIII noble metal loaded ZSM-48 catalyst.

5. The wear resistant lubricant formulation of claim 1, 2, 3, or 4 wherein the non-ionic ashless antiwear additive is at least one selected from thioxomalonate, 2,2-dithiopyridine, organic group substituted 2,2-dithiopyridine, thiazolidine and organic group substituted thiazolidine.

6. The wear resistant lubricant formulation of claim 5 wherein the non-ionic ashless antiwear additive is present in the lubricant formulation in an amount in the range of about 0.065 to about 650 mmoles.

7. The wear resistant lubricant formulation of claim 5 wherein the non-ionic ashless antiwear additive is present in the lubricant formulation in an amount in the range of about 0.065 to about 200 mmoles.

8. The wear resistant lubricant formulation of claim 5 wherein the non-ionic ashless antiwear additive is present in the lubricant formulation in an amount in the range of about 0.65 to about 65 mmols.

9. The wear resistant lubricant formulation of claim 5 wherein the non-ionic ashless antiwear additive is present in the lubricant formulation in an amount in the range of about 0.65 to about 35 mmoles.

10. The wear resistant lubricant formulation of claim 5 further containing at least one additional performance enhancing additive.

11. The wear resistant lubricant formulation of claim 10 wherein when another antiwear additive is present the mmole ratio of non-ionic ashless antiwear additive: another antiwear additive is in the range of about 1:10 to 200:1.

12. The wear resistant lubricant formulation of claim 11 wherein the mmole ratio of non-ionic ashless antiwear additive: another antiwear additive is in the range of about 1:10 to 100:1.

13. The wear resistant lubricant formulation of claim 11 wherein the mmole ratio of non-ionic ashless antiwear additive: another antiwear additive is in the range of about 1:10 to 50:1.

14. The wear resistant lubricant formulation of claim 11 wherein the mmole ratio of non-ionic ashless antiwear additive: another antiwear additive is in the range of about 1:10 to 10:1.

15. The wear resistant lubricant formulation of claim 5 selected from the group consisting of a multigrade internal combustion engine crankcase oil, a transmission oil, a turbine oil and a hydraulic oil.

16. The wear resistant lubricant formulation of claim 5 comprising a GTL material derived basestock and at least one other base stock selected from the group consisting of natural base stock, synthetic basestock, other GTL base stock/base oil or a base oil derived from waxy hydrocarbon stock, slack wax or waxy paraffinic Fischer-Tropsch hydrocarbon by hydroisomerization or isodewaxing and mixtures thereof.

17. The wear resistant lubricating oil formulation of claim 1 having a sulfur content ranging between 0.8-0.4 wt% or less, an ash content ranging between 1.2-0.4 wt% or less, and a phosphorus content ranging between 0.18-0.05 wt% or less.

* * * * *